US005335461A

United States Patent [19]

Petersen et al.

[11] Patent Number: 5,335,461

[45] Date of Patent: Aug. 9, 1994

[54] BALCONY WINDOW WITH SIDE RAILING FOR INSTALLATION IN AN INCLINED ROOF

[75] Inventors: Flemming O. Petersen, Bloustrod; Claes Lindgren, Farum; Brent Moller, Gentofte; Stig F. Vigenberg, Gilleleje, all of Denmark

[73] Assignee: V. Kann Rasmussen Industri A/S, Soborg, Denmark

[21] Appl. No.: 849,382

[22] PCT Filed: Feb. 6, 1991

[86] PCT No.: PCT/DK91/00033

§ 371 Date: May 7, 1992

§ 102(e) Date: May 7, 1992

[87] PCT Pub. No.: WO90/09493

PCT Pub. Date: Aug. 23, 1990

[30] Foreign Application Priority Data

Mar. 7, 1990 [DK] Denmark ..... 589/90

[51] Int. Cl.[5] ..... E04B 7/18

[52] U.S. Cl. ..... 52/72; 52/200; 49/246; 49/248; 49/250; 49/258; 49/260

[58] Field of Search ..... 52/72, 66, 69, 200, 52/204.1; 49/240, 250, 260, 247, 248, 246, 257, 258, 261, 371

[56] References Cited

U.S. PATENT DOCUMENTS

| | | | |
|---|---|---|---|
| 3,190,689 | 6/1965 | Calthorpe | 52/72 |
| 3,212,813 | 10/1965 | Peterson et al. | 52/72 |
| 4,064,649 | 12/1977 | Rasmussen et al. | 49/250 |
| 4,870,984 | 10/1989 | Roth | 52/69 |

FOREIGN PATENT DOCUMENTS

| | | | |
|---|---|---|---|
| 0308105 | 3/1989 | European Pat. Off. . | |
| 817361 | 8/1951 | Fed. Rep. of Germany | 52/72 |
| 2914475 | 10/1980 | Fed. Rep. of Germany | 52/72 |
| 8707653 | 9/1987 | Fed. Rep. of Germany . | |
| 2488322 | 2/1982 | France | 52/200 |
| WO90/09493 | 8/1990 | PCT Int'l Appl. . | |

*Primary Examiner*—Michael Safavi
*Attorney, Agent, or Firm*—Lane, Aitken & McCann

[57] ABSTRACT

A window for installation in an inclined roof has a main frame and a bottom-hinged lower window frame which opens outwards to a substantially vertical position to form a breast wall. Each of two handrails forms the upper edge of a side railing between the lower window frame and a side portion of the main frame when the window is in the open balcony position. Each handrail has a length which is sufficient to form the upper side edge of the side railing when the window is installed at the lowest roof inclination within a specified angular range and can be cut to adapt its length to the actual roof inclination after the handrail is connected to the lower window frame and the associated side portion of the main frame. Vertical rail bars in each side railing are connected to the associated handrail by pivotal joints that are longitudinally displaceable in relation to the handrail and can be fastened in arbitrary positions along the handrail.

6 Claims, 4 Drawing Sheets

BALCONY WINDOW WITH SIDE RAILING FOR INSTALLATION IN AN INCLINED ROOF

On the basis of the technical teaching derivable from DE-GM 8707653, the invention relates to a window for installation in an inclined roof with a main frame in which an upper window frame and a bottom-hinged lower frame are journalled, which frames in their closed position are situated in extension of each other in the height direction of the main frame and together cover the main frame opening, whereas the lower window frame by opening may be turned outwards into a substantially vertical position to form the breast wall of a balcony.

Said publication discloses an embodiment having a bottom-hinged lower frame in connection with a displaceable upper frame.

When the main frame is installed with its bottom member at a suitably low height above the floor in a top storey of a building, part of the closet space situated at the roof foot may be used as a balcony or roof terrace when the two window frames are opened, the lower frame forming a breast wall and the upper frame which may be top-hinged constituting a shed roof thereover, whereas the balcony is sidewards limited by side railings connected between either side of the lower window frame and the associated main frame side member and being unfolded and folded up upon opening and closing the lower window frame.

The object of the invention is to provide a window arrangement which in a relatively simple manner may be adapted to installation in inclined roof surfaces with varying inclinations within a predetermined angular range, e.g. 35°–55°.

Based on the recognition of the fact that in order to meet aesthetic demands it is important that the handrails of the side railings with the lower window frame opened to a vertical position are substantially horizontal and the vertical bars of the side railings substantially vertical, the window according to the invention is characterized in that handrails connected between the lower window frame and each of the side portions of the main frame, and each forming in the open balcony position of the window the upper edge of a side railing, each have a length suitable for installation of the window at the smallest roof inclination within a specified angular range and is designed to be cut off for adaptation of its length to the actual roof inclination after having been permanently connected to the lower window frame and the relevant side portion of the main frame in its almost horizontal position, and vertical rail bars of each side railing being connected to the associated horizontal rail by means of pivotal joints, which are longitudinally displaceable in relation to the horizontal rail and can be fastened in arbitrary positions along same.

With this design of the handrail of each side railing and the joints for the vertical rail bars designed for connection therewith, it is obtained that during installation with the lower window frame being placed in its vertical position and the handrail in its horizontal position and after connection of the handrail to the side portion of the main frame and the lower window frame, respectively, a possible necessary adjustment of the length of the handrail can be made by cutting off the end of it projecting beyond the lower window frame. The vertical rail bars can then be placed in vertical positions evenly spaced, and their upper pivotal joints fastened to the handrail.

A simple embodiment which is easy to install can be obtained by shaping the horizontal rail as a U-profile with inwards turned edge portions at its downwards facing aperture for guiding said pivotal joints for the vertical rail bars, said pivotal joints being shaped as a U-profile adapted to fit into the handrail with a fastening screw for securing the pivotal joint against displacement in relation to the handrail, one of two pivotally connected parts of a fitting connected to the lower window frame being likewise shaped as a U-profile adapted to matchingly surround the handrail.

In order to facilitate fastening of the horizontal rail to the lower window frame prior to length adjustment said one part of the fitting connected to the lower window frame is provided with a predrilled hole for use as a jig when fastening the horizontal rail to the fitting prior to length adjustment of the rail.

In a further preferred embodiment the height above the balcony floor of the breast wall formed by the lower window frame can be reduced when the window is opened into its balcony position as disclosed in the unpublished international patent application PCT/DK89/00029, while at the same time the vertical bars of the side railings are still brought into vertical positions by pivotal connections between both ends of the bottom portion of the lower window frame and the bottom end of a rail which is telescopically displaceable from the corresponding main frame side member with a view to lowering the lower window frame from the main frame during opening, a guiding rail for said telescopically displaceable rail fastened on the side portion of the main frame forming a track for slide or roller members at the bottom ends of the freely suspended vertical rail bars.

By designing the handrail so that its remote end relative to the lower window frame is pivotally connected to a slide shoe for engagement with a sliding rail fastened to the side portion of the main frame, on which a stop member is mounted during installation of the handrail for limiting the movement of the slide shoe when opening the window, the handrail can contribute to stabilizing the lower window frame during and after opening into its balcony position, so that other stabilizing devices such as, e.g. oblique stay members which might mar the appearance of the side railings, can be avoided.

The invention will now be explained in detail with reference to the schematic drawing, in which FIG. 1 is a perspective view of a part of an inclined roof with the lower window frame of a balcony window according to the invention opened into the balcony position;

Figure 1:
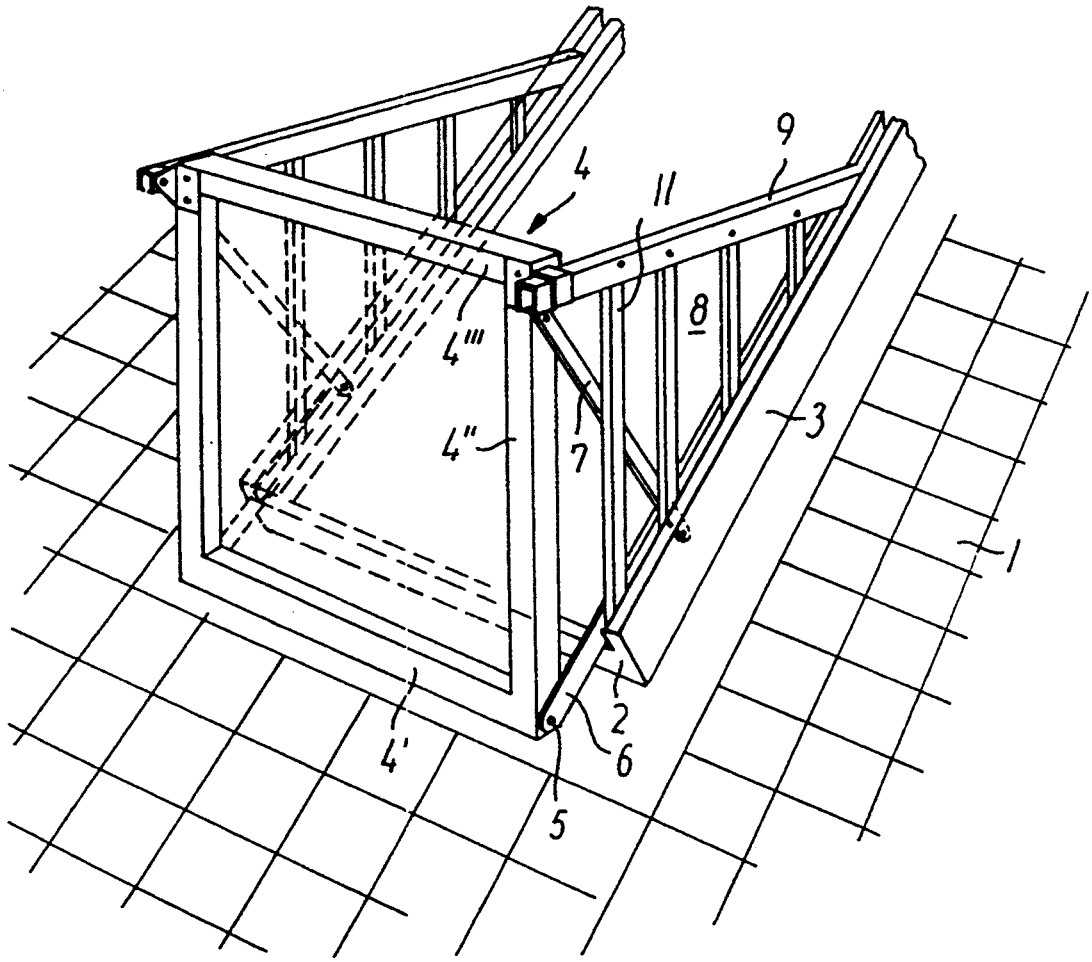

Reference numeral 1 in FIG. 1 is a section of for example a slated roof with an inclination of about 45°, in which a main frame is installed having a bottom member 2 and two side members 3 as well as a top member not shown. A lower window frame 4 with a bottom member 4', to side members 4" and a top member 4"' is at either side at its bottom through pins 5 hinged to the lower end of a telescopically displaceable supporting bar 6 parallel to the main frame side member 3 concerned. The supporting bar 6 thereby becomes translatorily displaceable between a position in which the pin 5 is immediately adjacent to the main frame bottom member 2, and the position depicted in FIG. 1, in which it is displaced downwards along the roof surface. Near its top end, each frame side member 4" can, as shown, be connected to the corresponding main frame side member 3 through an oblique telescopic stay member 7, to facilitate closing of the lower window frame 4, the oblique stay member reaching a stop during closing, from where the top member 4"' of the frame during the continued closing movement describes part of a circle having its centre at the hinging point of the oblique stay member relative to the main frame and in this way forces the frame upwards, rather than performing the closing process, e.g. by inwards turning of the frame and a subsequent lifting of it to the final closed position. In the shown vertical position, as explained above, the frame may as described above constitute the breast wall of a balcony when the the main frame bottom member 2 is at a suitably low height above the floor in the room, not shown, under the roof 1.

Two side railings 8 with handrails 9, which at their forwards facing ends are hinged to the frame side members 4" and at their other ends are pivotally connected to glide shoes in rails on the upper side of the main frame side members 3, serve the purpose of side limitation of the balcony. The handrails 9 are, as shown, connected to vertical rail bars 11, which upon closing the window are turned into the main frame together with the handrails 9 and possibly the oblique stay members 7.

Figure 2:
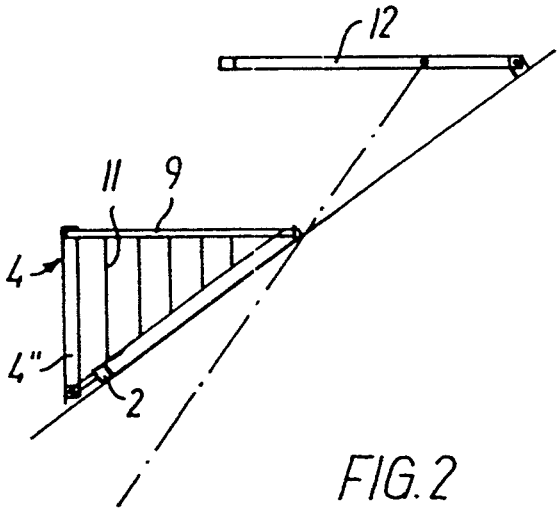
FIG. 2 illustrates the changed positions of the side railings of the balcony window for various roof inclinations.

The schematical view in FIG. 2 shows an embodiment, in which the upper window frame 12 is top-hinged so that when swung upwards to a mainly horizontal position it forms a shed roof which partly covers the balcony formed by the lower frame 4 having been swung outwards.

The figure shows, in solid lines, the side railing 8 of the balcony window for a roof inclination of 35°. As it will appear from the roof inclination shown in dashed lines of approx. 55° the handrail 9 of the side railing 8 must at such a steeper inclination be significantly shorter, and the positions of the vertical rail bars 11 must be altered accordingly.

To allow adaptation of one and the same embodiment of the side railing to different roof inclinations within a given angular range, e.g. 35°–55°, the handrail 9 has the length required for the lowest inclination within said range, in this case 35° and is designed so that its length can be adjusted to the actual roof inclination after connection of the handrail 9 to the lower window frame 4 and the main frame side member 3 and placing it in the horizontal position, the vertical rail bars being connected to the handrail 9 by means of pivotal joints that are longitudinally displaceable relative to the handrail 9 and can be fastened in arbitrary positions along same.

Figure 3:
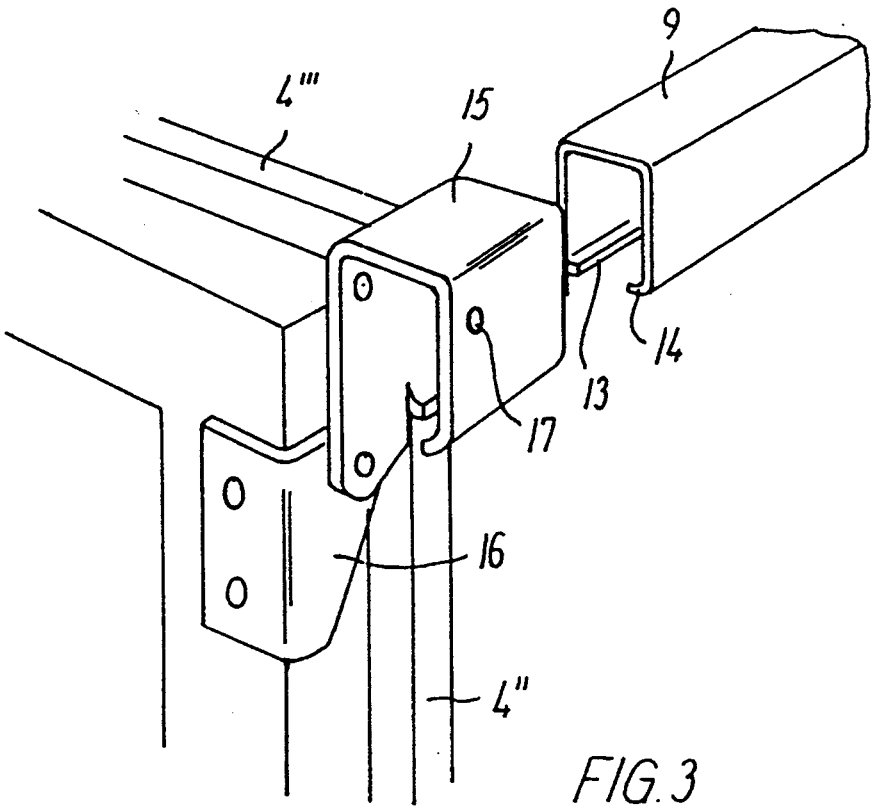
FIGS. 3 and 4 show the connection between the lower window frame and the handrail of each side railing in a preferred embodiment.
Figure 4:
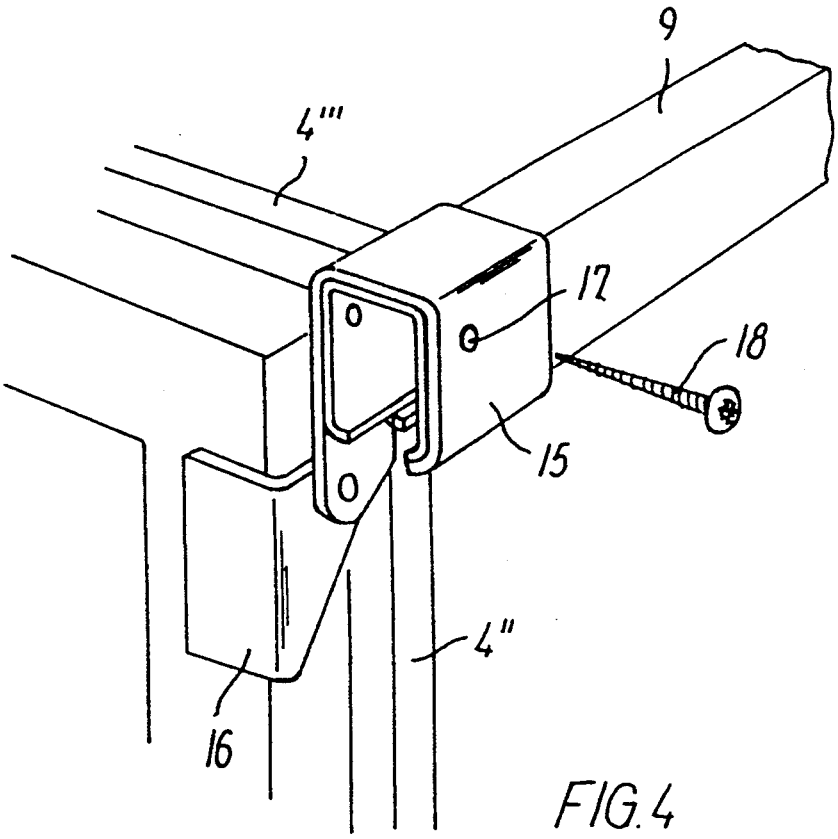

In a preferred embodiment the handrail 9 as shown in FIGS. 3 and 4, is shaped as a U-profile having a downwards aperture provided with inwards turned edge portions 13, 14 which serve to secure and retain the pivotal joints of the vertical bars in the handrail.

For connection to the handrail 9 a fitting is fastened at the upper end of each of the side members 4" of the lower window frame 4, said fitting consisting of two pivotally connected parts 15, 16, of which one 15 is a U-profile shaped to be pushed on and matchingly surround the handrail 9. The other part 16 of the fastening fitting may, as shown, be an L-profile for fastening on the front side of the frame side member 4".

Figure 5:
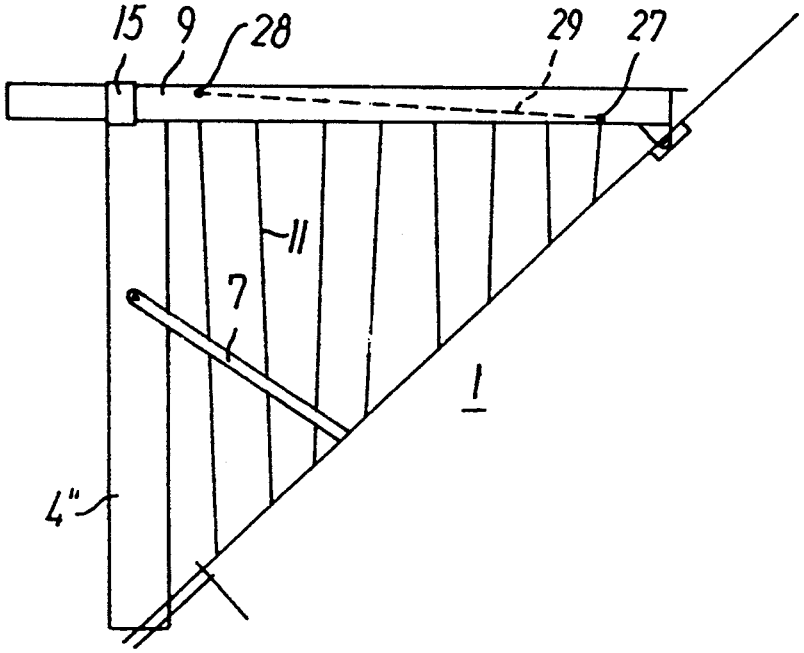
FIG. 5 illustrates the adjustment of the length of the handrail.

In the fitting part 15 to be pushed on the handrail 9 a predrilled hole 17 is provided, which serves as a jig for drilling in the handrail 9, when this and the lower window frame 4 have been adjusted to horizontal and vertical positions, respectively, as shown in FIG. 5 for the actual roof inclination.

After drilling of holes in the horizontal rail 9 the fitting part 15 is fastened to same by means of a screw 18, and for roof inclinations steeper than the minimum inclination corresponding to the full length of the horizontal rail 9, the necessary length adjustment of the horizontal rail can now be made by cutting off the part of the horizontal rail projecting beyond the lower window frame 4.

Figure 6:
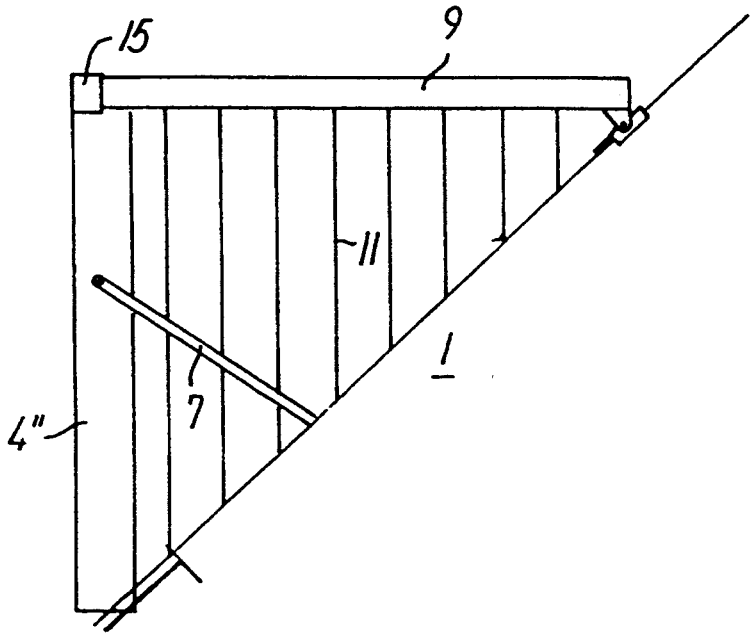
FIGS. 6 and 7 shows the adjustment of the vertical bars of the side railings and fastening of their upper pivotal joints to the handrail.

The handrail having been adjusted, the vertical rail bars must now be adjusted so that they are evenly spaced over the length of the handrail 9 between the lower frame 4 and the frame side member 3, as shown in FIG. 6.

Figure 7:
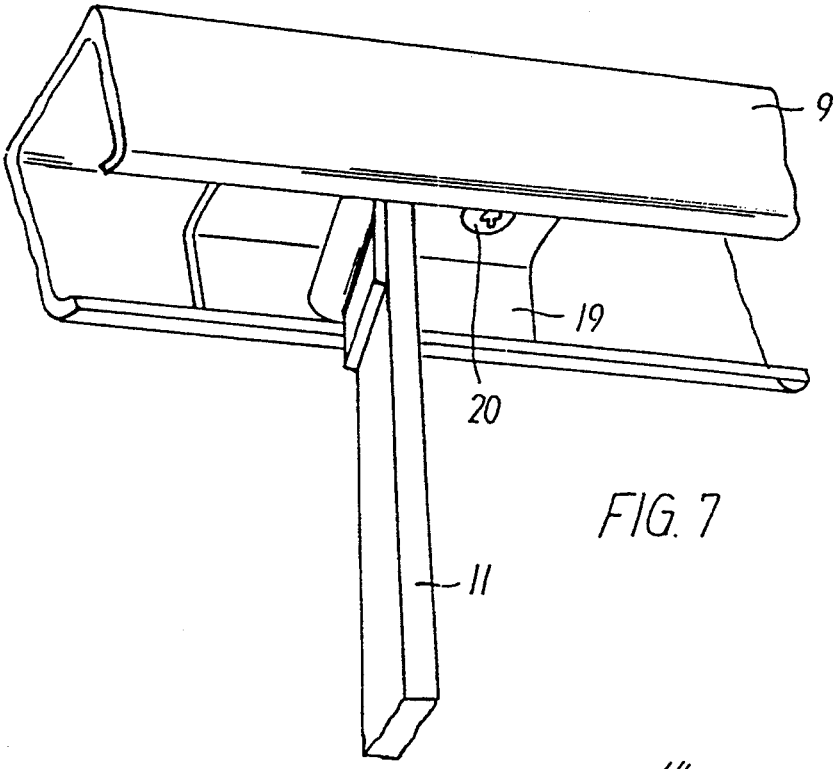

To obtain the necessary displaceability of the vertical rail bars 11 along the handrail 9, the joints 19 of the vertical bars are designed as U-profiles as shown in FIG. 7 doe internal matching arrangement in the handrail 9. The joint 19 is provided with a fastening screw 20 for fastening in an arbitrary position along the handrail 9, which screw when tightened is pressed against the underside of the upper wall of the handrail 9, so that the joint 19 is pressed against the inwards turned edge portions 13, 14 of the handrail in a manner known per se from certain curtain rod slides.

The hinging points of the vertical bars 11 in the joints 19 as shown in FIG. 6 are adapted in a way that ensures that the hinging point 27 for the shortest vertical bar is positioned at a low level in the handrail 9, whereas the hinging point 28 for the longest vertical bar is positioned at a high level, and the hinging points for the interjacent vertical bars are positioned on a straight line between said hinging points 27 and 28. Thereby, the vertical bars 11 will go free of each other when the rail is folded up.

Figure 8:
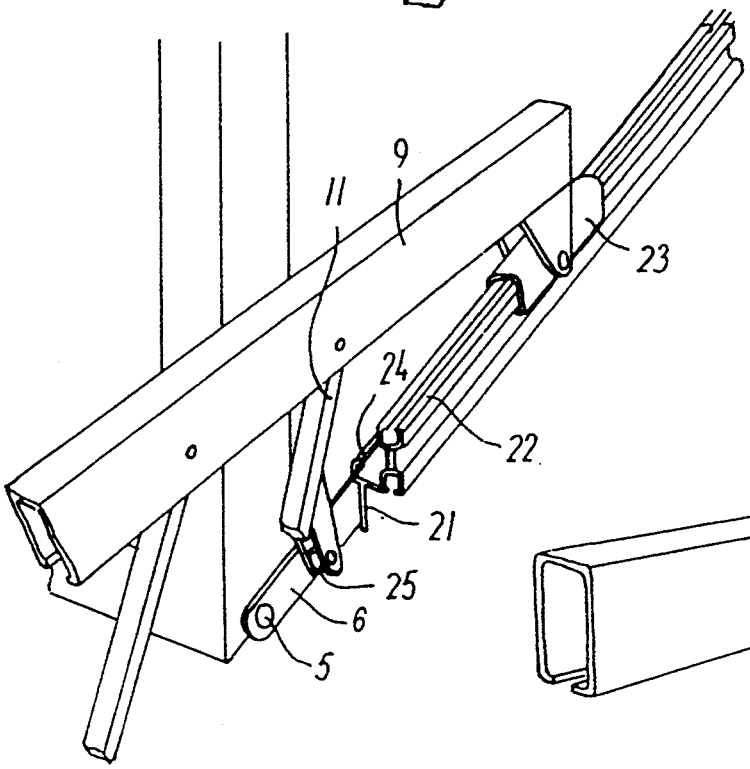
FIG. 8 is an embodiment with possibility of lowering the lower window frame from the main frame when turning out to balcony position.

As shown in FIG. 8, the telescopically displaceable supporting bar 6 which, when the lower window frame 4 is turned outwards, lowers the bottom member 4' of same from the bottom member 2 of the main frame, is journalled in a guiding rail 21 fastened to the main frame side member 3.

In the embodiment shown this guiding rail is integral with a slide rail 22 for a slide shoe 23 provided as an upwards turned U-profile, which is pivotally connected to the end of the handrail 9 remote from the lower frame 4 and surrounds the U-shaped slide rail 22. The guiding rail 21 is connected to the slide rail 22 by means of a partition wall 24, which forms a track for rollers 25 placed on the bottom end of the vertical bars 11. The vertical rail bars 11 fastened by means of the pivotal joints 19 are thus freely suspended from the handrail 9. The vertical displacement of the partition wall 24 down under the slide rail 22 allows space for the vertical bars to be turned into the main frame when the lower window frame 4 is closed.

Figure 9:
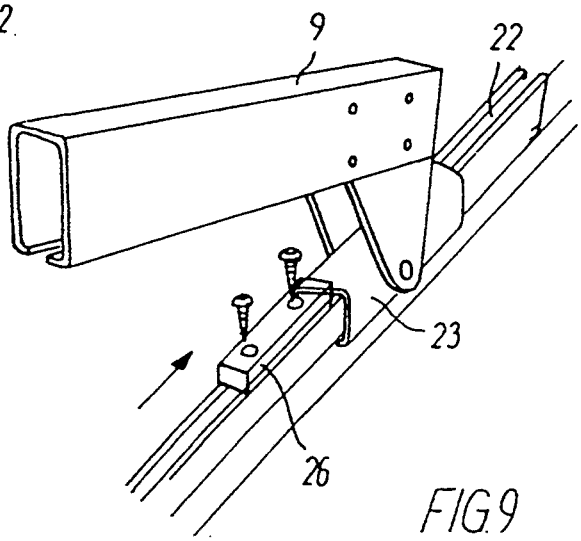
FIG. 9 shows the connection between the handrail and a side portion of the main frame.

A stop member 26 can, as shown in FIG. 9, be mounted on the slide rail 22 after installation of the side railing to limit the downwards movement of the slide shoe 22 when the lower window frame 4 is opened. Thereby the handrail 9 contributes to securing the necessary stability of the lower window frame, so that special devices for this purpose such as, e.g. the oblique stay members 7 may be dispensed with.

We claim:

1. A window for installation in an inclined roof having an actual inclination within a specified angular range of roof inclinations, the range including a smallest roof inclination, the window having a main frame (2, 3), in which an upper window frame and a bottom-hinged lower window frame (4) are journalled, which frames in their closed position are situated in extension of each other in the height direction of the main frame and together cover the main frame opening, wherein the lower window frame by opening may be turned outwards into a substantially vertical position to form a breast wall of a balcony, characterized in that handrails (9) connected between the lower window frame (4) and each of the side portions (3) of the main frame form in the open balcony position of the window the upper edge of a side railing (8), each handrail having a length suitable for installation of the window at the smallest roof inclination within the specified angular range and being designed to be cut off for adaptation of said length to the actual roof inclination after having been permanently connected in a generally horizontal position to the lower window frame (4) and an adjacent one of said side portions of the main frame (3), and vertical rail bars (11) of each side railing (8) being connected to an adjacent one of the handrails by means of pivotal joints (19), which are longitudinally displaceable in relation to the handrails (9) and can be fastened in arbitrary positions along same.

2. A window as claimed in claim 1, characterized in that the handrail (9) is shaped as a U-profile with inwards turned edge portions (13, 14) at its downward facing aperture for guiding said pivotal joints (19) for the vertical rail bars, said pivotal joints (19) being shaped as a U-profile adapted to fit into the handrail (9) with a fastening screw (20) for securing the pivotal joint against displacement in relation to the handrail, one (15) of two pivotally connected parts (15, 16) of a fitting connected to the lower window frame being likewise shaped as a U-profile adapted to matchingly surround the handrail (9).

3. A window as claimed in claim 2, characterized in that the hinging points of the vertical rail bars (11) in relation to the handrail (9) are adjusted so that the hinging point (27) for the shortest bar is positioned at a low level in the rail (9), whereas the hinging point (28) for the longest bar is positioned at a high level, the hinging points for the interjacent vertical bars being positioned on a straight line (29) between said two hinging points.

4. A window as claimed in claim 2, characterized in that said one part (15) of the fitting (15, 16) connected to the lower window frame (4) is provided with a predrilled hole for use as a jig when fastening the horizontal rail (9) to the fitting prior to length adjustment of the rail.

5. A window as claimed in claim 1, characterized in that tracks (24) for slide or roller members (25) at the bottom ends of the vertical rail bars (11) are formed by guiding rails (21) for telescopically displaceable rails (6) fastened to the main frame side portions, the telescopically displaceable rails having bottom ends pivotally connected to a bottom portion (4') of the lower window frame (4) in order to lower the lower window frame (4) in relation to the main frame during opening.

6. A window as claimed in claim 1 characterized in that the end of the handrail (9) remote from the lower window frame (4) is pivotally connected to a slide shoe (23) for engagement with a sliding rail (22) fastened to the side portion of the main frame, on which a stop member (26) is mounted during installation of the handrail (9) for limiting the movement of the slide shoe (23) when opening the window.

* * * * *

UNITED STATES PATENT AND TRADEMARK OFFICE

CERTIFICATE OF CORRECTION

PATENT NO. : 5,335,461

DATED : August 9, 1994

INVENTOR(S) : FLEMMING O. PETERSEN ET AL.

It is certified that error appears in the above-indentified patent and that said Letters Patent is hereby corrected as shown below:

On the title page item [87], "WO90/09493" should be --WO91/14068--; and line 16, "Aug. 23, 1990" should be --Sept. 19, 1991--.

Signed and Sealed this

Twentieth Day of December, 1994

*Attest:*

Bruce Lehman

BRUCE LEHMAN

*Attesting Officer*

*Commissioner of Patents and Trademarks*